US012038010B1

(12) United States Patent
Chai

(10) Patent No.: US 12,038,010 B1
(45) Date of Patent: Jul. 16, 2024

(54) FOLDING ROTATABLE HANDHELD FAN

(71) Applicant: Wenjie Chai, Hubei (CN)

(72) Inventor: Wenjie Chai, Hubei (CN)

(73) Assignee: Shenzhen Zou Yuan Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/619,158

(22) Filed: Mar. 28, 2024

(30) Foreign Application Priority Data

Feb. 21, 2024 (CN) ..... 202420319346.7

(51) Int. Cl.
*F04D 25/08* (2006.01)
*F04D 25/06* (2006.01)
*F04D 29/64* (2006.01)

(52) U.S. Cl.
CPC ..... *F04D 25/084* (2013.01); *F04D 25/0673* (2013.01); *F04D 29/644* (2013.01)

(58) Field of Classification Search
CPC ... F04D 25/084; F04D 25/0673; F04D 29/644
See application file for complete search history.

(56) References Cited

U.S. PATENT DOCUMENTS

2004/0197199 A1* 10/2004 Cheng ..... F04D 29/601 417/234
2021/0180601 A1* 6/2021 Ling ..... F04D 29/053

OTHER PUBLICATIONS

徐佳玲, S16 Little Bear Folding Fan, Feb. 18, 2024, Sweetfull, (Year: 2024).*

* cited by examiner

*Primary Examiner* — Sabbir Hasan
*Assistant Examiner* — Andrew J Marien

(57) ABSTRACT

A folding rotatable handheld fan includes a hand grip, a rotating handle, a fan assembly and a battery. The fan assembly is mounted at an end portion of the rotating handle. An end portion of the rotating handle away from the fan assembly is connected with a rotating ring. A display module is arranged in an end portion of the rotating handle close to the rotating ring. The display module includes a circuit board and a display. The circuit board is mounted in the rotating handle. The display is connected to a side surface of the circuit board. The display is threaded out of the rotating handle. The display extends into the rotating ring. The rotating ring is rotatably connected to an end portion of the hand grip. An end portion of the rotating ring away from the rotating handle passes through the hand grip.

10 Claims, 7 Drawing Sheets

FOLDING ROTATABLE HANDHELD FAN

TECHNICAL FIELD

The present disclosure relates to the technical field of fans, and in particular, to a folding rotatable handheld fan.

BACKGROUND OF THE INVENTION

A handheld fan is a handheld cooling product. It is loved by the great majority of consumers due to its portability.

In the related technology, a folding rotatable handheld fan mainly includes a hand grip, a rotating handle, and a fan assembly. An end portion of the rotating handle is connected to an end portion of the hand grip through a rotating shaft. The fan assembly is mounted at an end portion of the rotating handle away from the rotating shaft. Turning the rotating handle around an axial line of the rotating shaft can fold the handheld fan to shorten the handheld fan. In order to inform a user of a gear and battery level of the handheld fan, a display module will be arranged on a surface of the hand grip. The display module is connected to a battery inside the rotating handle through a wire passing through the rotating shaft.

Regarding the above-mentioned related technology, when the handheld fan is used, the rotating handle is rotated around the axial line of the rotating shaft and drives the rotating shaft to rotate. During multiple rotations of the rotating handle, the wire between the display module and the battery will be worn out. Meanwhile, due to the non-directional rotation of the rotating handle, the wire for connecting the display module to the battery will be entangled together. Over time, the wire will pull welding points on the display module and the battery, and the wire at the welding points falls off. As a result, the handheld fan fails to be used and needs to be disassembled for repair. This shortens the service life of the handheld fan.

SUMMARY OF THE INVENTION

In order to prolonging the service life of the handheld fan, the present application provides a folding rotatable handheld fan.

A folding rotatable handheld fan provided in the present disclosure adopts the following technical solution:

A folding rotatable handheld fan includes a hand grip, a rotating handle, a fan assembly, and a battery, wherein the fan assembly is mounted at an end portion of the rotating handle; an end portion of the rotating handle away from the fan assembly is connected with a rotating ring; a display module is arranged in an end portion of the rotating handle close to the rotating ring; the display module includes a circuit board and a display; the circuit board is mounted in the rotating handle; the display is connected to a side surface of the circuit board; the display is threaded out of the rotating handle, and the display extends into the rotating ring; the rotating ring is rotatably connected to an end portion of the hand grip; an end portion of the rotating ring away from the rotating handle passes through the hand grip; the battery is mounted in the rotating handle; and the battery is electrically connected to the circuit board.

Optionally, the hand grip includes a first baffle plate and a second baffle plate; the first baffle plate and the second baffle plate are arranged in parallel; a side surface of one end of the first baffle plate is connected with a support plate; a side surface of one end of the second baffle plate is connected with a plug plate; the plug plate is plugged into an end surface of the support plate close to the second baffle plate; the rotating handle is located between the first baffle plate and the second baffle plate; the rotating ring is rotatably connected to a side surface of the second baffle plate close to the first baffle plate; and the rotating ring is located at an end portion of the second baffle plate away from the plug plate.

Optionally, the rotating handle includes an upper shell and a lower shell; the upper shell and the lower shell are buckled together; and the upper shell and the lower shell are detachably connected to each other.

Optionally, the fan assembly includes a motor, a mounting assembly, and a fan blade; the motor is mounted in the upper shell and the lower shell; the motor is located at one end of the upper shell close to the support plate and one end of the lower shell close to the support plate; an output shaft of the motor faces the upper shell and extends out of the upper shell; the mounting assembly is mounted on the output shaft of the motor; and a connecting end of the fan blade is rotatably connected into the mounting assembly.

Optionally, the mounting assembly includes a mounting plate and a limiting plate; a side surface of the mounting plate is connected with a connecting rod; the output shaft of the motor is plugged into the connecting rod from an end surface of the connecting rod; a side surface of the mounting plate close to the connecting rod is connected with a mounting column; a side surface of the limiting plate is provided with a limiting slot used for plugging the mounting column; an end surface of the mounting column is connected with a limiting column; a slot bottom of the limiting slot is provided with a through hole for the limiting column to pass through; an end portion of the connecting rod is arranged in the limiting plate in a penetrating manner; a side surface of the limiting plate away from the mounting plate is provided a clamping slot; the connecting rod extends into the clamping slot; a side surface of the end portion of the connecting rod is connected with a clamping block; the clamping block abuts against a slot bottom of the clamping slot; a connecting end of the fan blade is connected with a rotating block; the rotating block sleeves a circumferential surface of the mounting column; and the fan blade is located between the second baffle plate and the upper shell.

Optionally, the side surface of the second baffle plate close to the first baffle plate is provided with a positioning plate; a plurality of positioning slots are arranged at an end portion of the positioning plate away from the second baffle plate; and a side edge of the fan blade is clamped in the positioning slots.

Optionally, one end of the upper shell away from the support plate protrudes outwards from the inside to form a boss; the circuit board and the display are both located in the boss; the rotating ring includes a support section, a limiting section, and a mounting section; the support section is mounted on a side surface of the boss close to a side surface of the second baffle plate; the support section passes through the second baffle plate; the support section rotates in the second baffle plate; the limiting section is connected to a side surface of the support section away from the boss; the limiting section abuts against a side surface of the second baffle plate away from the first baffle plate; and the mounting section is connected to a side surface of the limiting section.

Optionally, a protective plate is arranged on an inner peripheral surface of the mounting section; two elastic plates are connected to a periphery of a side surface of the protective plate close to the display; the two elastic plates are symmetrically arranged about the protective plate; side surfaces, away from each other, of the two elastic plates are connected with clamping strips; an inner peripheral surface of the support section is provided with clamping slots matched with the clamping strips; an inner peripheral surface of the limiting section is connected with a support block; the protective plate abuts against a surface of the support block; and light of the display is transmitted through the protective plate.

Optionally, a side surface of the first baffle plate close to the second baffle plate is connected with a rotating column; the rotating column is coaxial with the rotating ring; a side surface of the lower shell close to the upper shell is connected with a mounting block; a side surface of the lower shell close to first baffle plate is provided with a rotating slot matched with the rotating column; the rotating slot extends into the mounting block; and the rotating column rotates on an inner wall of the rotating slot.

Optionally, a side surface of the circuit board away from the display is connected with a lighting lamp; a lamp holder of the lighting lamp faces one end away from the fan assembly and extends out of the lower shell; a side surface of the circuit board close to the display is connected with a charging connector; and the charging connector faces one end away from the fan assembly and extends out of the upper shell.

In summary, the present disclosure includes at least one of the following beneficial effects:

1. The display module is arranged in the rotating handle, so that the display module and the battery are located in the same shell, and the display is arranged in the rotating ring. When the rotating handle is driven to rotate, the rotating handle drives the display module to rotate. Meanwhile, the rotating handle drives the rotating ring to rotate, so as not to cause wire wear and entanglement, which is conducive to prolonging the service life of the handheld fan. Moreover, when the handheld fan is used, a gear and battery level of the handheld fan can be observed through the display arranged inside the rotating ring.
2. When the fan blade is stored between the second baffle plate and the upper shell, as the fan blade is a twisted blade, the side edge of the fan blade is clamped in the positioning slots. The positioning slots fix the fan blade, making it difficult for the fan blade to run out of the space between the second baffle plate and the upper shell when a user carries the fan, thus protecting the fan blade.
3. When rotated, the rotating handle is rotated in the second baffle plate through the rotating ring. Meanwhile, the rotating handle is rotated through the cooperation between the rotating column and the rotating slot, making the rotation of the rotating handle more stable and the structural strength higher.

DETAILED DESCRIPTION OF THE INVENTION

Figure 1:
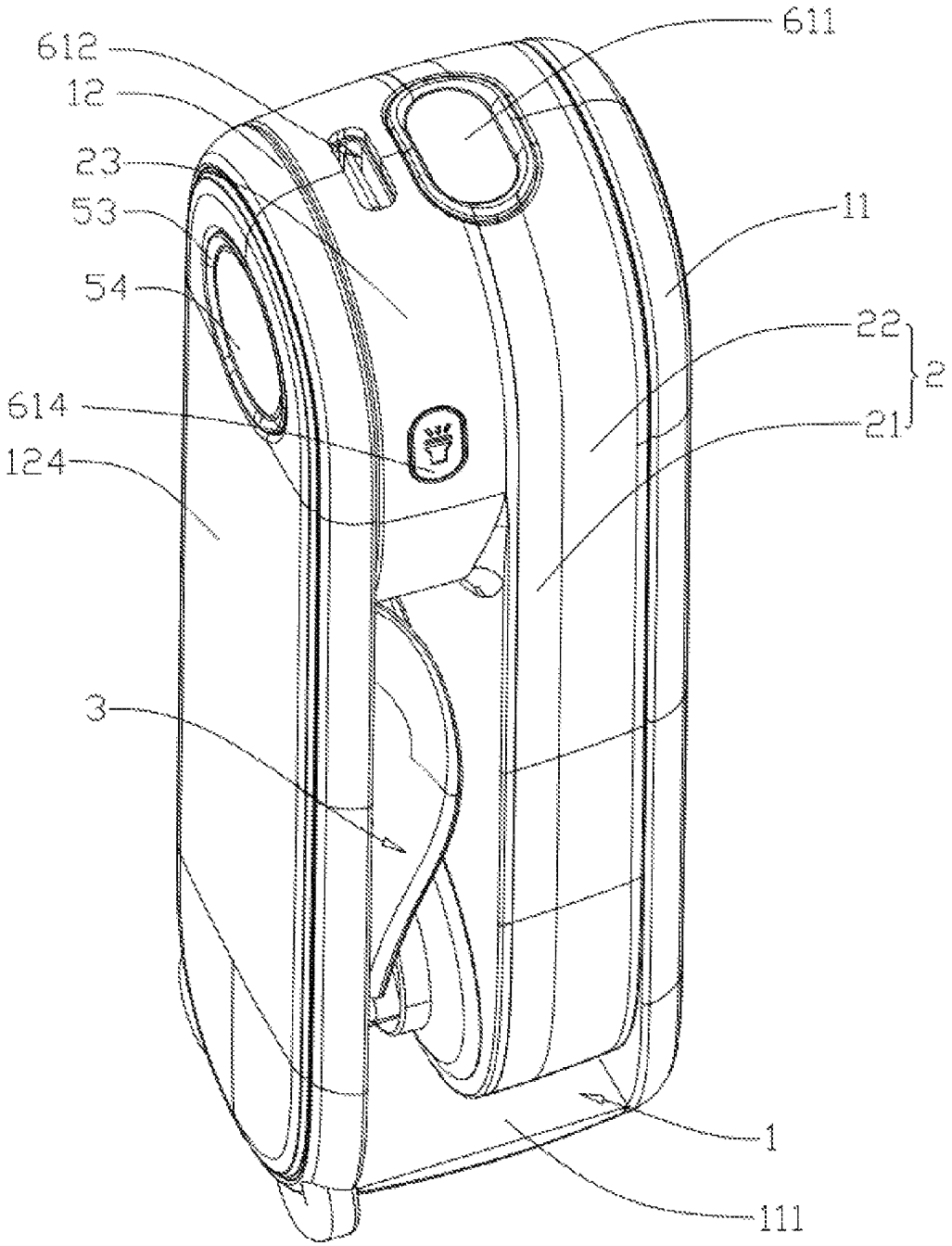
FIG. 1 is a schematic structural diagram of a handheld fan according to an embodiment of the present disclosure.
Figure 2:
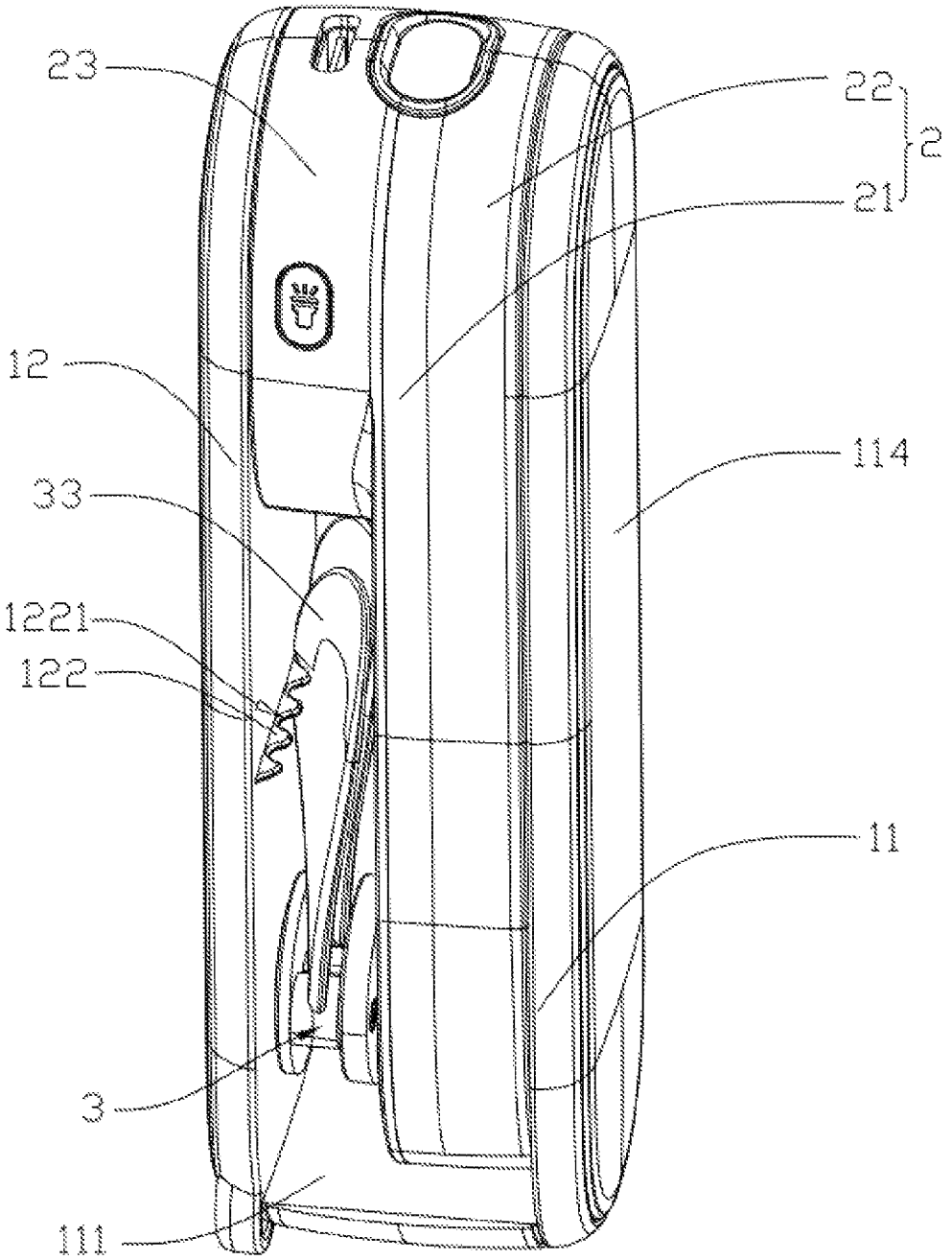
FIG. 2 is a schematic structural diagram of another viewing angle of a handheld fan according to an embodiment of the present disclosure.
Figure 3:
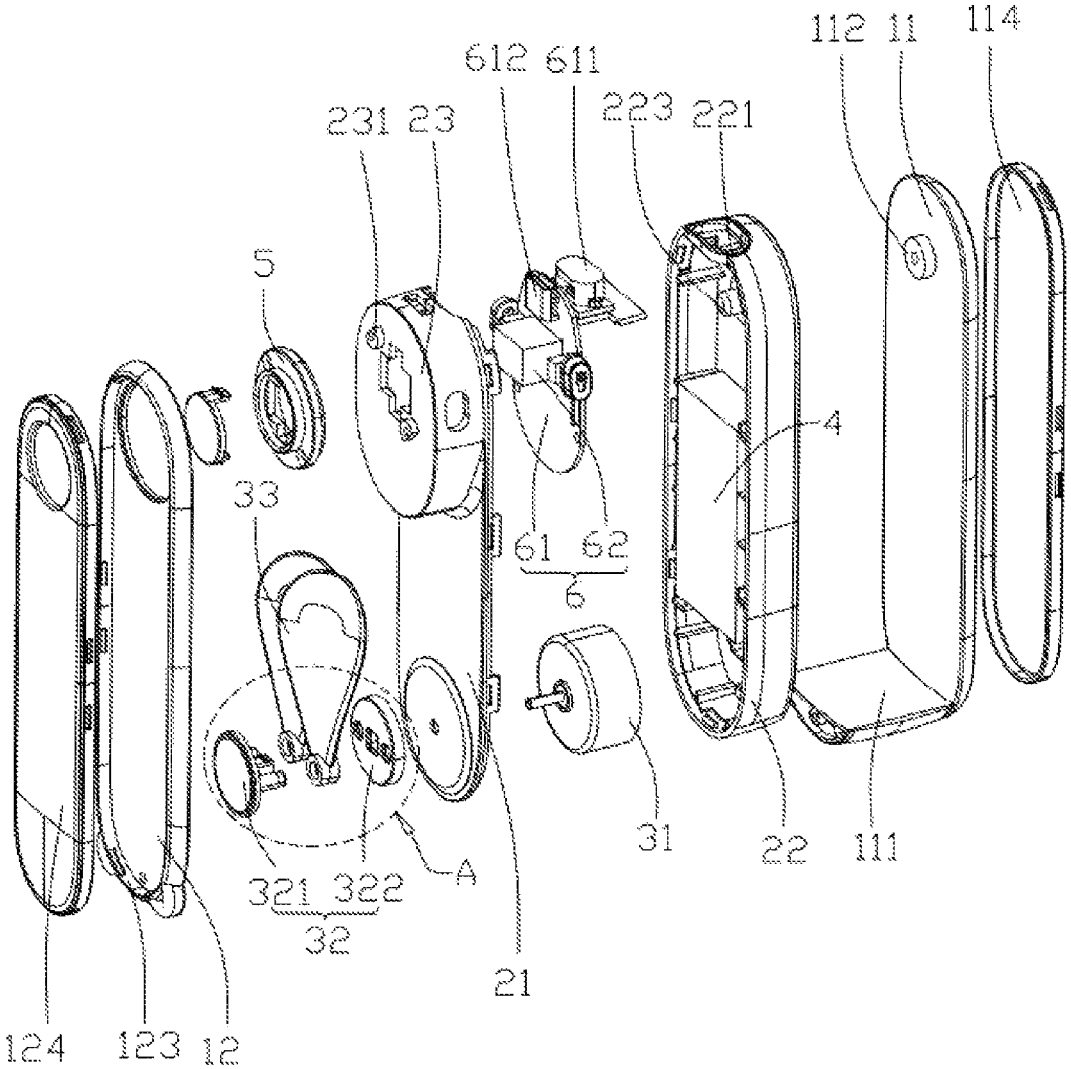
FIG. 3 is a schematic diagram of an exploded structure of a handheld fan according to an embodiment of the present disclosure.
Figure 4:
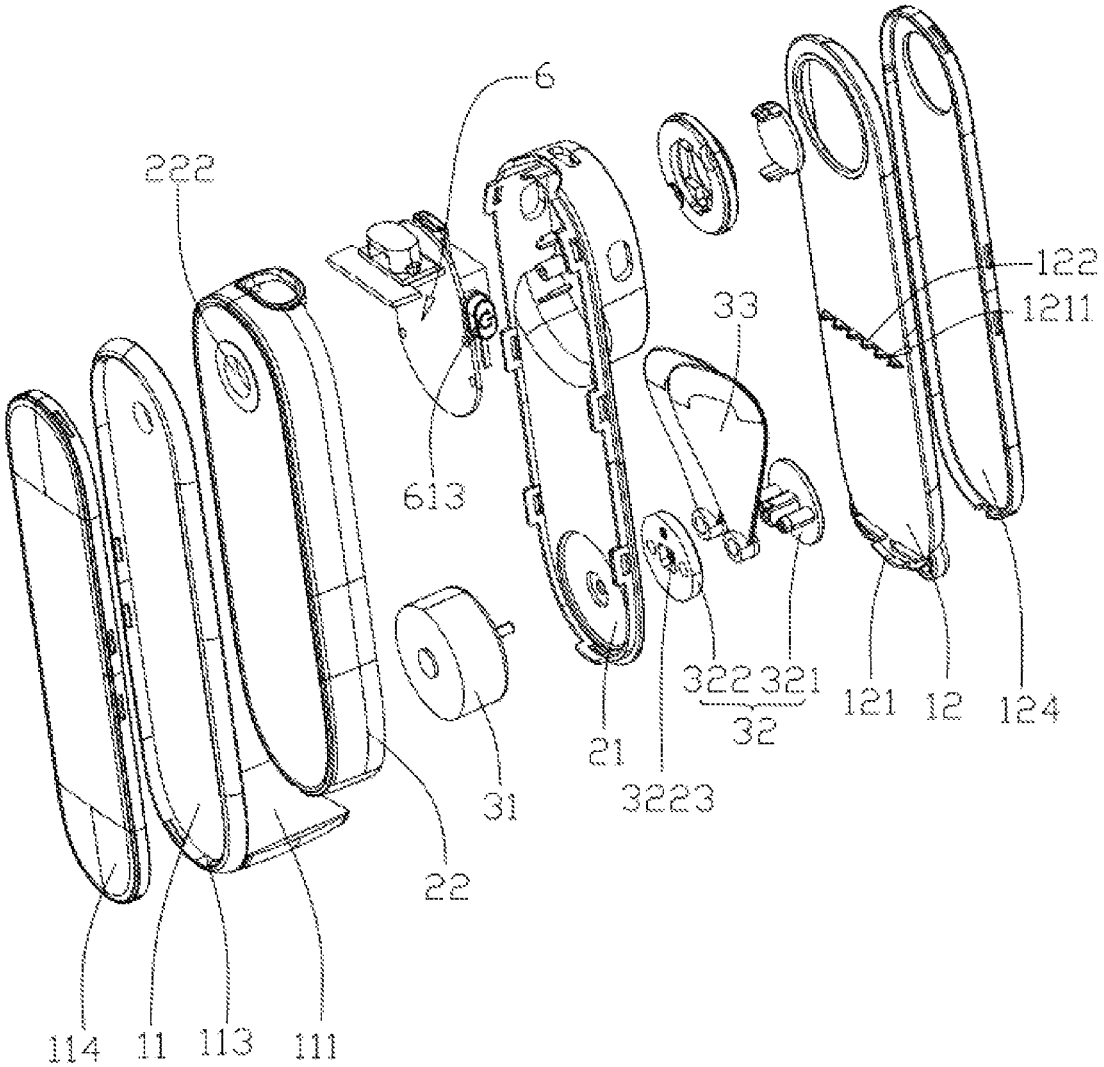
FIG. 4 is a schematic diagram of an exploded structure of another viewing angle of a handheld fan according to an embodiment of the present disclosure.
Figure 5:
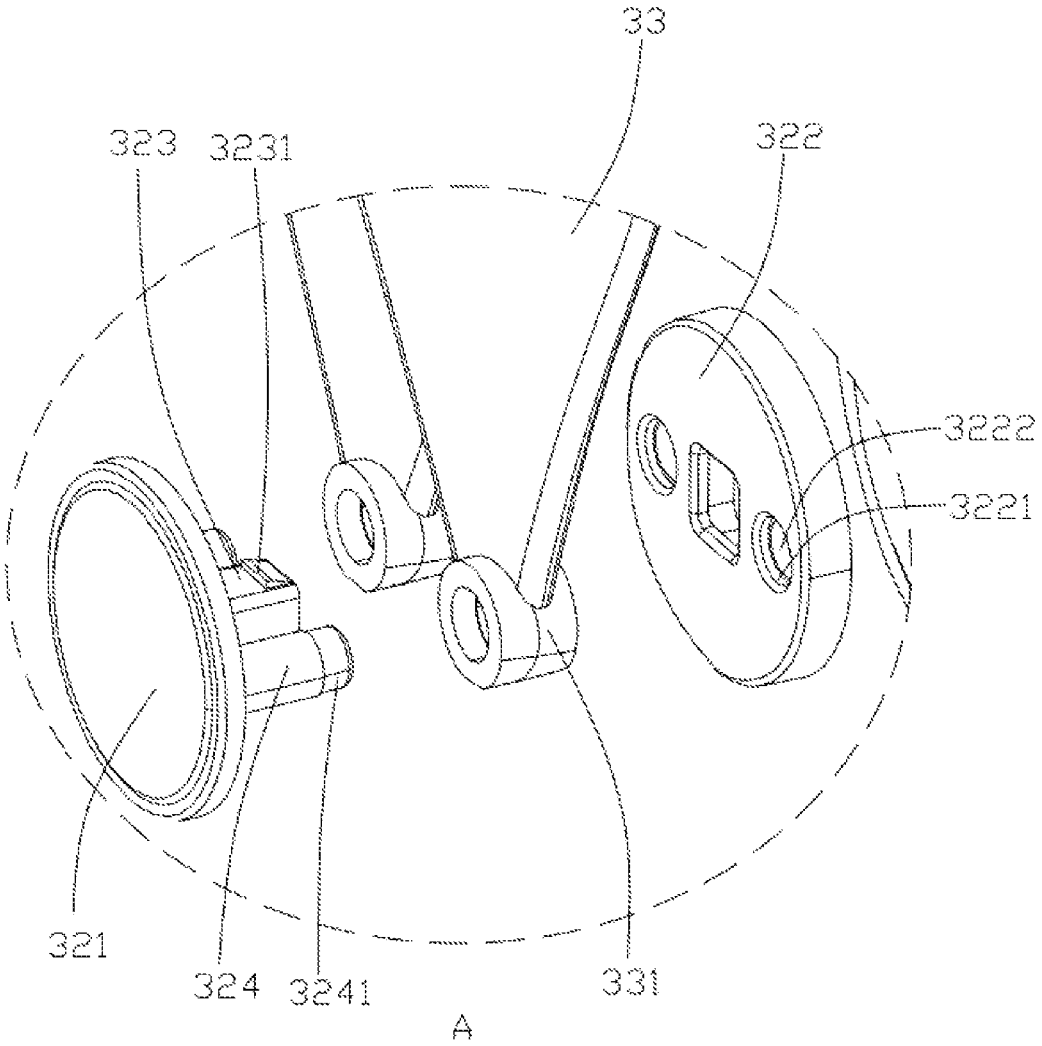
FIG. 5 is a schematic diagram of an enlarged structure of a portion A in FIG. 3.
Figure 6:
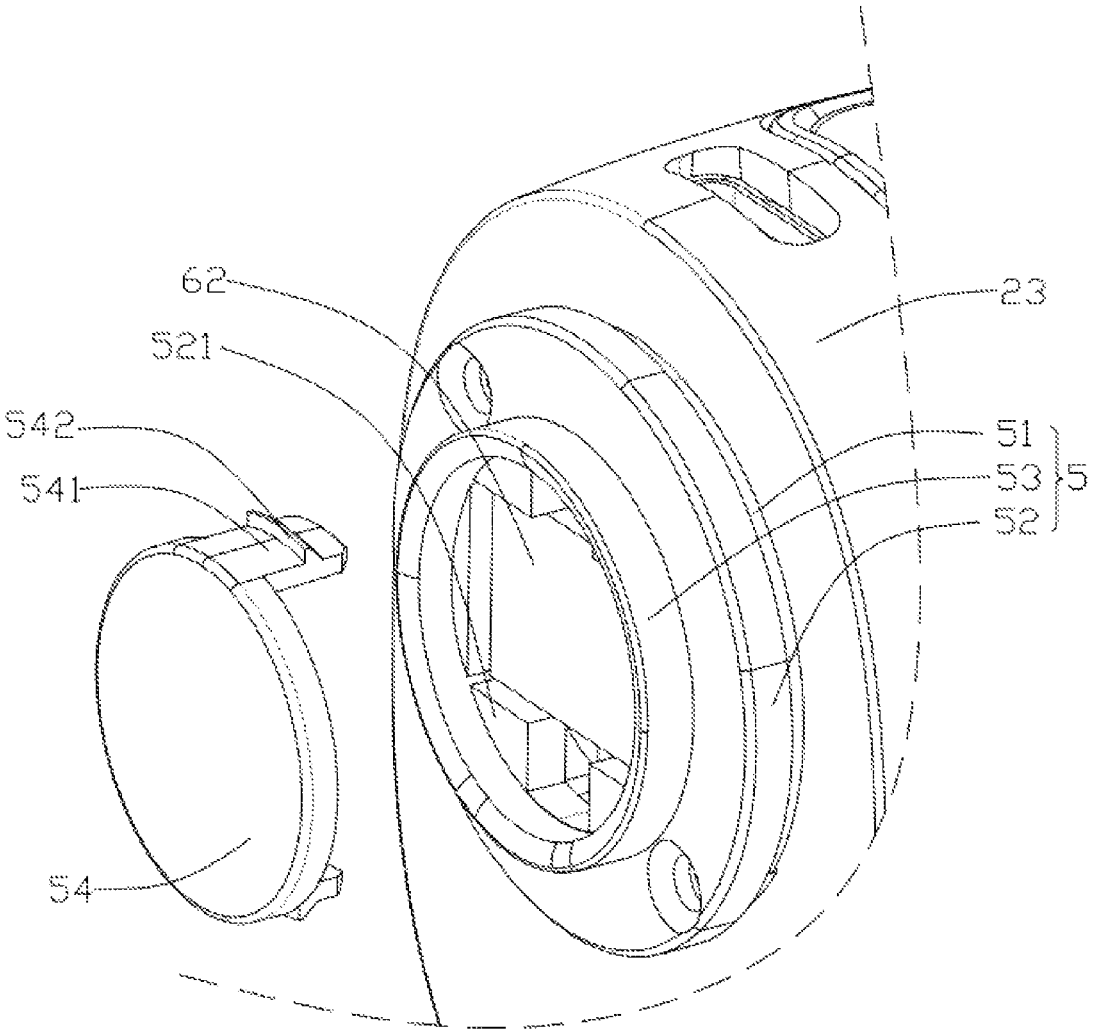
FIG. 6 is a partially schematic structural diagram of a handheld fan according to an embodiment of the present disclosure.
Figure 7:
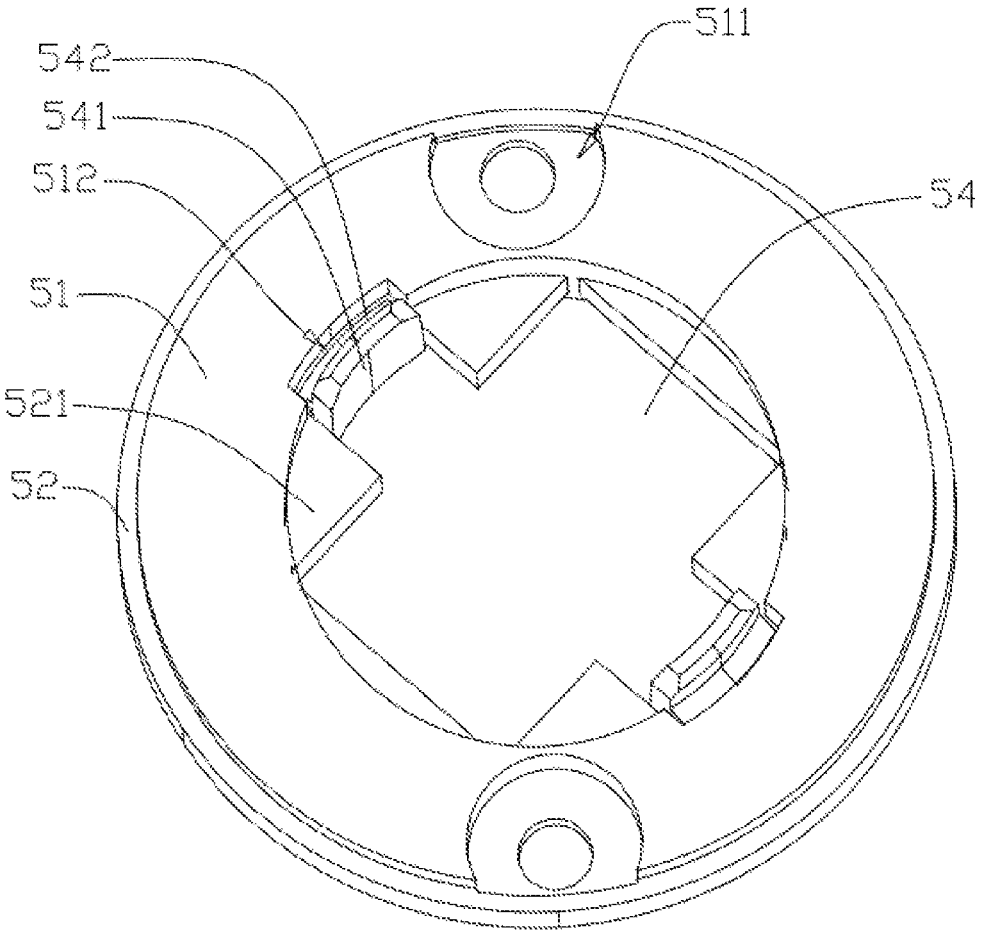
FIG. 7 is a schematic structural diagram of a rotating ring according to an embodiment of the present disclosure.

The present disclosure will be further explained below in detail in conjunction with FIG. 1 to FIG. 7.

The embodiments of the present disclosure disclose a folding rotatable handheld fan. Referring to FIG. 1 to FIG. 7, the folding rotatable handheld fan includes a hand grip 1, a rotating handle 2, a fan assembly 3, and a battery 4; the fan assembly 3 is mounted at an end portion of the rotating handle 2; an end portion of the rotating handle 2 away from the fan assembly 3 is connected with a rotating ring 5; a display module 6 is arranged in an end portion of the rotating handle 2 close to the rotating ring 5; the display module 6 includes a circuit board 61 and a display 62; the circuit board 61 is mounted in the rotating handle 2; the display 62 is connected to a side surface of the circuit board 61 close to the rotating ring 5; the display 62 is threaded out of the rotating handle 2, and the display 62 extends into the rotating ring 5; the rotating ring 5 is rotatably connected to an end portion of the hand grip 1; an end portion of the rotating ring 5 away from the rotating handle 2 passes through the hand grip 1; the battery 4 is mounted in the rotating handle 2; and the battery 4 is electrically connected to the circuit board 61.

The display module 6 is arranged in the rotating handle 2, so that the display module 6 and the battery 4 are located in the same shell, and the display 62 is arranged in the rotating ring 5. When the rotating handle 2 is driven to rotate, the rotating handle 2 drives the display module 6 to rotate. Meanwhile, the rotating handle 2 drives the rotating ring 5 to rotate, so as not to cause wire wear and entanglement, which is conducive to prolonging the service life of the handheld fan. Moreover, when the handheld fan is used, a gear and battery level of the handheld fan can be observed through the display 62 arranged inside the rotating ring 5.

The hand grip 1 includes a first baffle plate 11 and a second baffle plate 12; the first baffle plate 11 and the second baffle plate 12 are arranged in parallel; a side surface of one end of the first baffle plate 11 is connected with a support plate 111; a side surface of one end of the second baffle plate 12 is connected with a plug plate 121; the plug plate 121 is plugged into an end surface of the support plate 111 close to the second baffle plate 12; the first baffle plate 11 and the second baffle plate 12 are connected to each other through a screw; the screw passes through the support plate 111; the rotating handle 2 is located between the first baffle plate 11 and the second baffle plate 12; the rotating ring 5 is rotatably connected to a side surface of the second baffle plate 12 close to the first baffle plate 11; and the rotating ring 5 is located at an end portion of the second baffle plate 12 away from the plug plate 121.

When the rotating handle 2 needs to be stored, the rotating handle 2 is rotated, so that the rotating handle 2 enters a space between the first baffle plate 11 and the second baffle plate 12, and the hand grip 1 stores the rotating handle 2. When the fan needs to be used, the rotating handle 2 is rotated 180° around an axial line of the rotating ring 5. The rotating handle 2 is rotated out of the hand grip 1 to use the fan. The hand grip 1 and the rotating handle 2 are rotated to be folded, making the fan have a smaller volume and easier to carry. The hand grip 1 also provides protection for the fan and the rotating handle 2.

The rotating handle 2 includes an upper shell 21 and a lower shell 22. The upper shell 21 and the lower shell 22 are clamped by buckles. The fan assembly 3 includes a brush motor 31, a mounting assembly 32, and a fan blade 33. The mounting assembly 32 includes a mounting plate 321 and a limiting plate 322. The brush motor 31 is mounted in the upper shell 21 and the lower shell 22. The brush motor 31 is located at one end of the upper shell 21 close to the support plate 111 and one end of the lower shell 22 close to the support plate 111. An output shaft of the brush motor 31 faces the upper shell 21 and extends out of the upper shell 21. A middle position of a side surface of the mounting plate 321 is connected with a connecting rod 323. The output shaft of the brush motor 31 is plugged into the connecting rod 323 from an end surface of the connecting rod 323. The output shaft of the brush motor 31 is in interference with the connecting rod 323. The side surface of the mounting plate 321 close to the connecting rod 323 is connected with two mounting columns 324. A side surface of the limiting plate 322 is provided with two limiting slots 3221 for plugging the two mounting columns 324. End surfaces of the mounting columns 324 are connected with limiting columns 3241. Through holes 3222 for the limiting columns 3241 to pass through are formed in slot bottoms of the limiting slots 3221. An end portion of the connecting rod 323 is arranged in the limiting plate 322 in a penetrating manner; a side surface of the limiting plate 322 away from the mounting plate 321 is provided a clamping slot 3223; the connecting rod 323 extends into the clamping slot 3223; a side surface of the end portion of the connecting rod 323 is connected with a wedge-shaped clamping block 3231; and the wedge-shaped clamping block 3231 abuts against a slot bottom of the clamping slot 3223. The mounting columns 324 are symmetrically arranged about the connecting rod 323. There are two fan blades 33. Connecting ends of the fan blades 33 are connected with rotating blocks 331. The two rotating blocks 331 sleeve circumferential surfaces of the two mounting columns 324, and the fan blades 33 are located between the second baffle plate 12 and the upper shell 21.

When the fan is used, the motor 31 drives the mounting plate 321 to rotate, and the mounting plate 321 drives the limiting plate 322 and the fan blade 33 to rotate together. The fan blades 33 are gradually unfolded under the action of a centrifugal force, which can induce an air flow. When the fan is stored, the fan blades 33 rotate around the mounting columns 324 under the own gravity, and the two fan blades 33 are gathered together and are stored between the second baffle plate 12 and the upper shell 21.

The side surface of the second baffle plate 12 close to the first baffle plate 11 is provided with a positioning plate 122; a plurality of arc-shaped positioning slots 1221 are arranged at an end portion of the positioning plate 122 away from the second baffle plate 12; and a side edge of the fan blade 33 is clamped in the positioning slots 1221. When the fan blade 33 is stored between the second baffle plate 12 and the upper shell 21, as the fan blade 33 is a twisted blade, the side edge of the fan blade 33 is clamped in the positioning slots 1221. The positioning slots 1221 fix the fan blade 33, making it difficult for the fan blade 33 to run out of the space between the second baffle plate 12 and the upper shell 21 when a user carries the fan, thus protecting the fan blade 33.

One end of the upper shell 21 away from the brush motor 31 protrudes outwards from the inside to form a boss 23. The circuit board 61 and the display 62 are both located in the boss 23. An end surface of the boss 23 away from the lower shell 22 is connected with two positioning blocks 231. The rotating ring 5 includes a support section 51, a limiting section 52, and a mounting section 53. A circumferential surface of the support section 51 is provided with a positioning port 511 that cooperates with the two positioning blocks 231. The support section 51 passes through the second baffle plate 12. The support section 51 rotates in the second baffle plate 12. The limiting section 52 is connected to a side surface of the support section 51 away from the boss 23. The limiting section 52 abuts against a side surface of the second baffle plate 12 away from the first baffle plate 11. The limiting section 52 is connected to end surfaces of the two positioning blocks 231 by screws, and the mounting section 53 is connected to a side surface of the limiting section 52. A protective plate 54 is arranged on an inner peripheral surface of the mounting section 53; two elastic plates 541 are connected to a periphery of a side surface of the protective plate 54 close to the display 62; the two elastic plates 541 are symmetrically arranged about the protective plate 54; side surfaces, away from each other, of the two elastic plates 541 are connected with clamping strips 542; an inner peripheral surface of the support section 51 is provided with clamping slots 512 matched with the clamping strips 542; an inner peripheral surface of the limiting section 52 is connected with a support block 521; the protective plate 54 abuts against a surface of the support bloc 521; and light of the display 62 is transmitted through the protective plate 54.

When rotated, the rotating handle 2 is rotated in the second baffle plate 12 through the support section 51, and the limiting section 52 is matched with the rotating handle 2 to limit the second baffle plate 12 in the middle. A protective plate 54 is arranged in the mounting section 53. The protective plate 54 is clamped in the clamping slots 512 through the elastic plates 541 and the clamping strips 542. To remove the mounting ring from the boss 23, the elastic plates 541 are pushed to separate the clamping strips 542 from the clamping slots 512, so that the protective plate 54 can be removed from the mounting section 53. The protective plate 54 is to protect the display 62.

A side surface of the first baffle plate 11 close to the second baffle plate 12 is connected with a rotating column 112; the rotating column 112 is coaxial with the rotating ring 5; a side surface of the lower shell 22 close to the upper shell 21 is connected with a mounting block 221; a side surface of the lower shell 22 close to first baffle plate 11 is provided with a rotating slot 222 matched with the rotating column 112; the rotating slot 222 extends into the mounting block 221; and the rotating column 112 rotates on an inner wall of the rotating slot 222. A side surface of the mounting block 221 away from the lower shell 22 is connected with a connecting column 223, and the first baffle plate 11 is connected into the connecting column 223 through a screw.

When rotated, the rotating handle 2 is rotated in the second baffle plate 12 through the rotating ring 5. Meanwhile, the rotating handle 2 is rotated through the cooperation between the rotating column 112 and the rotating slot 222, making the rotation of the rotating handle 2 more stable and the structural strength higher.

A periphery of a side surface of the first baffle plate 11 away from the second baffle plate 12 is connected with a first side plate 113. An inner peripheral surface of the first side plate 113 is provided with a first cover plate 114. The first cover plate 114 is clamped to an inner side wall of the first side plate 113 through a buckle. A periphery of a side surface of the second baffle plate 12 away from the first baffle plate 11 is connected with a second side plate 123. An inner peripheral surface of the second side plate 123 is provided with a second cover plate 124. The second cover plate 124 is clamped to an inner side wall of the second side plate 123 through a buckle. The mounting section 53 passes through the second cover plate 124.

A side surface of the circuit board 61 away from the display 62 is connected with a light-emitting diode (LED) lighting lamp 611; a lamp holder of the lighting lamp 611 faces one end away from the fan assembly 3 and extends out of the lower shell 22; a side surface of the circuit board 61 close to the display 62 is connected with a charging connector 612; and the charging connector 612 faces one end away from the fan assembly 3 and extends out of the upper shell 21.

A circumferential surface of the boss 23 is provided with a power touch button 613. The power touch button 613 is connected to the circuit board 61. A light touch button 614 is further arranged on the circumferential surface of the boss 23. The light touch button 614 is connected to the circuit board 61. The power touch button 613 and the light touch button 614 are symmetrically arranged about the boss 23.

The implementation principle of the folding rotatable handheld fan according to the embodiments of the present disclosure is as follows: The display module 6 is arranged in the rotating handle 2, so that the display module 6 and the battery 4 are located in the same shell, and the display 62 is arranged in the rotating ring 5. When the rotating handle 2 is driven to rotate, the rotating handle 2 drives the display module 6 to rotate. Meanwhile, the rotating handle 2 drives the rotating ring 5 to rotate, so as not to cause wire wear and entanglement, which is conducive to prolonging the service life of the handheld fan. Moreover, when the handheld fan is used, a gear and battery level of the handheld fan can be observed through the display 62 arranged inside the rotating ring 5.

The above embodiments are only preferred embodiments of the present disclosure, and do not limit the protection scope of the present disclosure. Therefore, any equivalent changes made on the basis of the structure, shape, and principle of the present disclosure shall all fall within the protection scope of the present disclosure.

The invention claimed is:

1. A folding rotatable handheld fan, comprising a hand grip, a rotating handle, a fan assembly, and a battery, wherein the fan assembly is mounted at an end portion of the rotating handle; an end portion of the rotating handle away from the fan assembly is connected with a rotating ring; a display module is arranged in an end portion of the rotating handle close to the rotating ring; the display module comprises a circuit board and a display; the circuit board is mounted in the rotating handle; the display is connected to a side surface of the circuit board; the display is threaded out of the rotating handle, and the display extends into the rotating ring; the rotating ring is rotatably connected to an end portion of the hand grip; an end portion of the rotating ring away from the rotating handle passes through the hand grip; the battery is mounted in the rotating handle; and the battery is electrically connected to the circuit board.

2. The folding rotatable handheld fan according to claim 1, wherein the hand grip comprises a first baffle plate and a second baffle plate; the first baffle plate and the second baffle plate are arranged in parallel; a side surface of one end of the first baffle plate is connected with a support plate; a side surface of one end of the second baffle plate is connected with a plug plate; the plug plate is plugged into an end surface of the support plate close to the second baffle plate; the rotating handle is located between the first baffle plate and the second baffle plate; the rotating ring is rotatably connected to a side surface of the second baffle plate close to the first baffle plate; and the rotating ring is located at an end portion of the second baffle plate away from the plug plate.

3. The folding rotatable handheld fan according to claim 2, wherein the rotating handle comprises an upper shell and a lower shell; the upper shell and the lower shell are buckled together; and the upper shell and the lower shell are detachably connected to each other.

4. The folding rotatable handheld fan according to claim 3, wherein the fan assembly comprises a motor, a mounting assembly, and a fan blade; the motor is mounted in the upper shell and the lower shell; the motor is located at one end of the upper shell close to the support plate and one end of the lower shell close to the support plate; an output shaft of the motor faces the upper shell and extends out of the upper shell; the mounting assembly is mounted on the output shaft of the motor; and a connecting end of the fan blade is rotatably connected into the mounting assembly.

5. The folding rotatable handheld fan according to claim 4, wherein the mounting assembly comprises a mounting plate and a limiting plate; a side surface of the mounting plate is connected with a connecting rod; the output shaft of the motor is plugged into the connecting rod from an end surface of the connecting rod; a side surface of the mounting plate close to the connecting rod is connected with a mounting column; a side surface of the limiting plate is provided with a limiting slot used for plugging the mounting column; an end surface of the mounting column is connected with a limiting column; a slot bottom of the limiting slot is provided with a through hole for the limiting column to pass through; an end portion of the connecting rod is arranged in the limiting plate in a penetrating manner; a side surface of the limiting plate away from the mounting plate is provided a clamping slot; the connecting rod extends into the clamping slot; a side surface of the end portion of the connecting rod is connected with a clamping block; the clamping block abuts against a slot bottom of the clamping slot; a connecting end of the fan blade is connected with a rotating block; the rotating block sleeves a circumferential surface of the mounting column; and the fan blade is located between the second baffle plate and the upper shell.

6. The folding rotatable handheld fan according to claim 4, wherein the side surface of the second baffle plate close to the first baffle plate is provided with a positioning plate; a plurality of positioning slots are arranged at an end portion of the positioning plate away from the second baffle plate; and a side edge of the fan blade is clamped in the positioning slots.

7. The folding rotatable handheld fan according to claim 3, wherein one end of the upper shell away from the support plate protrudes outwards from the inside to form a boss; the circuit board and the display are both located in the boss; the rotating ring comprises a support section, a limiting section, and a mounting section; the support section is mounted on a side surface of the boss close to a side surface of the second baffle plate; the support section passes through the second baffle plate; the support section rotates in the second baffle plate; the limiting section is connected to a side surface of the support section away from the boss; the limiting section abuts against a side surface of the second baffle plate away from the first baffle plate; and the mounting section is connected to a side surface of the limiting section.

8. The folding rotatable handheld fan according to claim 7, wherein a protective plate is arranged on an inner peripheral surface of the mounting section; two elastic plates are connected to a periphery of a side surface of the protective plate close to the display; the two elastic plates are symmetrically arranged about the protective plate; side surfaces, away from each other, of the two elastic plates are connected with clamping strips; an inner peripheral surface of the support section is provided with clamping slots matched with the clamping strips; an inner peripheral surface of the limiting section is connected with a support block; the protective plate abuts against a surface of the support block; and light of the display is transmitted through the protective plate.

9. The folding rotatable handheld fan according to claim 3, wherein a side surface of the first baffle plate close to the second baffle plate is connected with a rotating column; the rotating column is coaxial with the rotating ring; a side surface of the lower shell close to the upper shell is connected with a mounting block; a side surface of the lower shell close to first baffle plate is provided with a rotating slot matched with the rotating column; the rotating slot extends into the mounting block; and the rotating column rotates on an inner wall of the rotating slot.

10. The folding rotatable handheld fan according to claim 3, wherein a side surface of the circuit board away from the display is connected with a lighting lamp; a lamp holder of the lighting lamp faces one end away from the fan assembly and extends out of the lower shell; a side surface of the circuit board close to the display is connected with a charging connector; and the charging connector faces one end away from the fan assembly and extends out of the upper shell.

* * * * *